United States Patent [19]

Davidson

[11] Patent Number: 4,480,255

[45] Date of Patent: Oct. 30, 1984

[54] METHOD FOR ACHIEVING HIGH ISOLATION BETWEEN ANTENNA ARRAYS

[75] Inventor: Allen L. Davidson, Crystal Lake, Ill.

[73] Assignee: Motorola Inc., Schaumburg, Ill.

[21] Appl. No.: 447,075

[22] Filed: Dec. 6, 1982

[51] Int. Cl.[3] ..... H01Q 1/52

[52] U.S. Cl. ..... 343/844; 343/853; 343/791

[58] Field of Search ..... 343/791, 799, 800, 844, 343/853, 890, 891, 792

[56] References Cited

U.S. PATENT DOCUMENTS

| | | | |
|---|---|---|---|
| 3,375,524 | 3/1968 | Kunemund et al. | 343/799 |
| 3,396,398 | 8/1968 | Dunlavy | 343/814 |
| 3,534,371 | 10/1970 | Seavey | 343/722 |
| 4,083,051 | 4/1978 | Woodward | 343/796 |
| 4,213,132 | 7/1980 | Davidson | 343/814 |

OTHER PUBLICATIONS

Article entitled "Antenna Systems for 800 MHZ" by William B. Bryson, published in 32nd IEEE Vehicular Technology Conference of May 23–26, 1982.

*Primary Examiner*—Eli Lieberman

*Attorney, Agent, or Firm*—John H. Moore; James W. Gillman; Edward M. Roney

[57] ABSTRACT

A method is disclosed whereby adjacent transmitting antenna arrays may be more closely spaced to each other and to receiving antenna arrays while still maintaining a high level of isolation between arrays. In each antenna array, first and second parts thereof are identified. The two parts of each transmitting array are driven in phase quadrature with each other and at substantially equal power levels, and the antenna arrays are spaced sufficiently close to each other so that radiation emitted by one array and received by another array undergoes a cancelling effect before reaching the RF generator associated with the other array. The two parts of each receiver array are coupled to their associated receiver by a signal path such that substantially quadrature phasing is established between the first and second parts thereof to cause received radiation to cancel in the signal path before reaching the receiver.

7 Claims, 5 Drawing Figures

METHOD FOR ACHIEVING HIGH ISOLATION BETWEEN ANTENNA ARRAYS

BACKGROUND OF THE INVENTION

This invention is directed generally to the field of RF (radio frequency) antenna systems and, more particularly, to a method for isolating the RF output of one antenna from the RF input to another closely-spaced antenna. In radio and television communications systems, it is common to have two or more transmitting antennas in relatively close physical proximity to one another, thereby to minimize the space required for an installation. Frequently, the closely-spaced antennas propagate transmissions which are at or near the same frequency. Thus, the problem arises as to how to isolate the transmission from one antenna from the RF generator powering the other antenna.

The foregoing problem is conventionally addressed by ensuring that adjacent antennas are separated from each other by a distance sufficient to provide about 20 db of isolation. Even though the isolation thus obtained is adequate for most applications, the physical space required for the antenna installation remains undesirably large.

According to another technique which is sometimes used to isolate adjacent antennas, an array of multiple hybrid networks is included between each antenna and its RF source. See, for example, U.S. Pat. No. 4,213,132. Although this technique serves its purpose well, it is desirable to minimize the use of such hybrid networks in order to reduce the cost of antenna installations.

Accordingly, it is a general object of the invention to provide an improved method of installing RF antenna arrays.

It is a more specific object of the invention to provide such a method by which antenna arrays can be more closely spaced to each other without degrading RF isolation between them.

It is another object of the invention to provide the close spacing and isolation referred to above while simultaneously eliminating or, at least, substantially reducing the need for hybrid networks.

SUMMARY OF THE INVENTION

According to the present invention, the required physical spacing between a pair of closely-spaced, co-linear antenna arrays is substantially reduced while maintaining a high level of isolation between them. For a pair of transmitting arrays, this result is obtained by identifying, for each antenna array, first and second parts thereof which are to receive RF power. For example, each of two antenna arrays may have an upper half and a lower half, both halves of which may include an equal number of radiators such as dipoles. The first and second parts of one array are driven in phase quadrature with each other and at substantially equal power levels so that the radiators in the upper half of the array emit radiation in phase quadrature with the radiation emitted by the radiators in the lower half of the same array. The first and second parts of the second array are also driven in phase quadrature with each other and at substantially equal power levels. The quadrature phasing associated with the second array is selected such that radiation emitted by the first array and received by the first part of the second array cancels radiation emitted by the first array and received by the second part of the second array.

The physical spacing between the first and second arrays is selected so that the maximum spacing therebetween substantially precludes radiation emitted by the first part of the first array from being received by the second part of the second array, and also precludes radiation emitted by the second part of the first array from being received by the first part of the second array. With this technique, the spacing between adjacent antenna arrays is substantially reduced, and yet a high degree of RF isolation is provided to substantially preclude RF radiation from one array from being coupled to the RF generator which powers the other array. A similar technique is applicable for antenna installations which include one or more receiving arrays in order to isolate a receiver from nearby transmitting arrays.

BRIEF DESCRIPTION OF THE FIGURES

The objects stated above and other objects of the invention are set forth more particularly in the following detailed description of the accompanying drawings, in which.

DESCRIPTION OF THE PREFERRED EMBODIMENT

Figure 1:
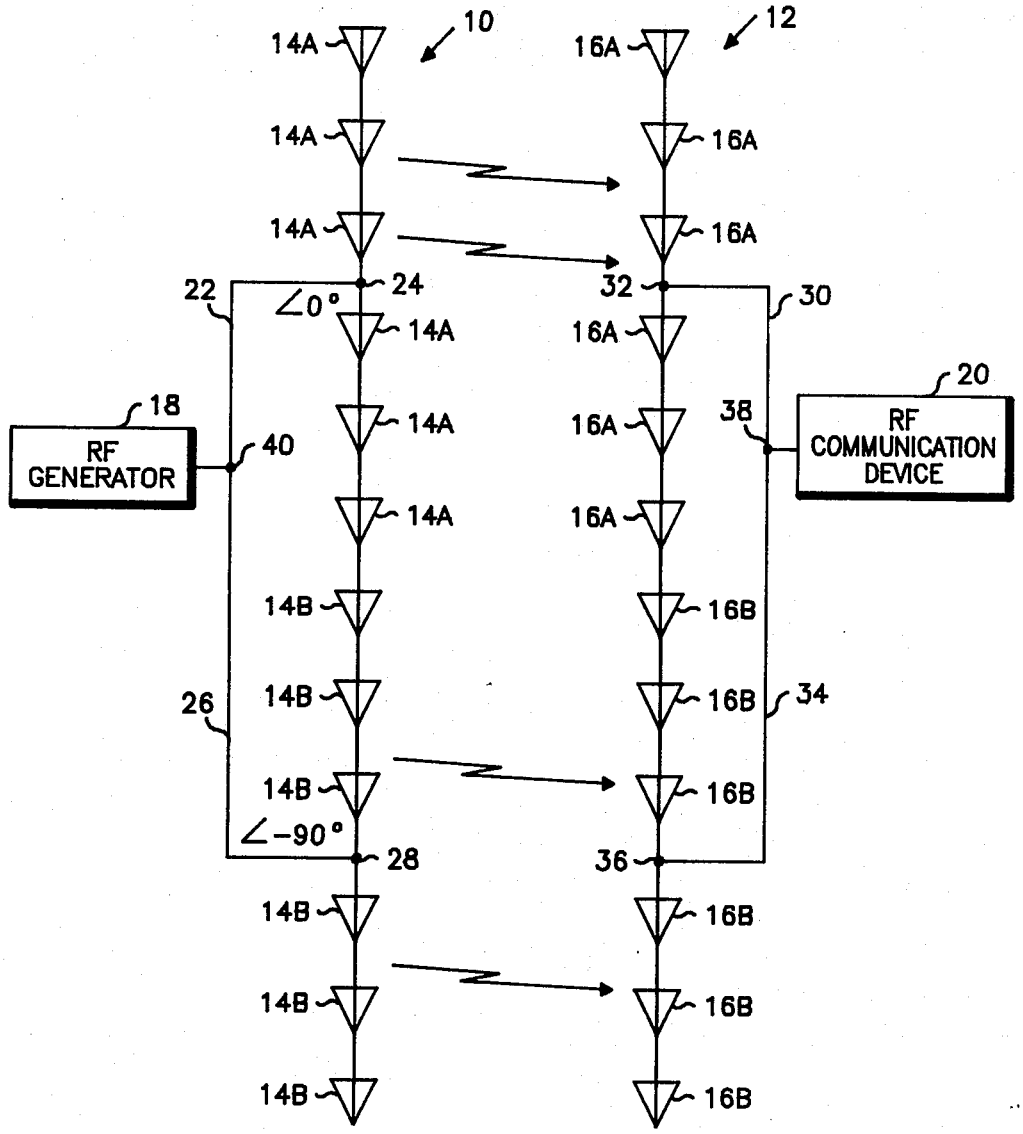
FIG. 1 is a schematic representation of an exemplary pair of co-linear antenna arrays in which improved isolation is provided in accordance with the invention.

Referring to FIG. 1, a pair of co-linear antenna arrays 10 and 12 are depicted for operating at or near the same RF frequency. As shown, the array 10 includes a plurality of radiators **14*a* and 14*b* and the array 12 includes a plurality of radiators 16*a* and 16*b***. For each array, the illustrated radiators may be conventional dipoles.

An RF generator 18 is provided for powering the array 10, while an RF communication device 20 is provided for the array 12. The device 20 may be an RF generator such as the generator 18 in the case where the array 12 is a transmitting array. In the case where the array 20 is a receiving array, the device 20 may be a radio receiver. The device 20 may also be a transceiver in the case where the array 20 is intended to both transmit and receive. The discussion immediately below assumes that the device 20 is an RF generator for a transmitter.

The generator 18 and the device 20 will, in many cases, be operating at or near the same frequency. Accordingly, unless the antenna array 10 is physically separated from the antenna array 12 by a sufficient distance, radiation emitted by the array 10 will be received by the array 12 and thereby be coupled to the device 20. Similarly, radiation emitted by the array 12 will be received by the array 10, and an undesirably high level of the received radiation will be coupled to the RF generator 18.

To substantially isolate the RF generator 18 and the device 20 from radiation emitted by the adjacent antenna array, an identification or selection is made of first and second parts of each array for the application of RF power thereto. Thus, for the example illustrated in FIG. 1, a first part of the array 10 preferably comprises six radiators 14*a*. The second part of the array 10 comprises the six radiators 14*b*. Likewise, a first part of the array 12 comprises the six radiators 16*a*, and the second part thereof comprises the six radiators 16*b*. Accordingly, the various parts of each of these exemplary arrays include an equal number of radiators.

The first and second parts of the array 10 are powered by the generator 18 such that the first part thereof (radiators 14*a*) is driven substantially in phase quadrature with the second part (radiators 14*b*) and at substantially equal power levels. Toward this end, the radiators 14*a* receive power from the generator 18 via an RF transmission line 22 which is coupled to a midpoint 24 above and below which an equal number (three in this example) of radiators 14*a* are situated. The radiators 14*b* receive power from the generator 18 via another RF transmission line 26 which is coupled to a midpoint 28 above and below which an equal number of radiators 14*b* are situated.

To drive the radiators 14*a* in phase quadrature with the radiators 14*b*, the lines 22 and 26 are selected such that their respective lengths cause a relative 90 degree phase difference to occur between the points 24 and 28. For example, assuming that the signal at point 24 is at 0°, the line 26 is selected to be sufficiently longer than the line 22 so that a relative phase angle of −90° degrees occurs in the signal at the point 28. With this arrangement, the antenna array 10 emits a beam of RF radiation which is tilted downwardly to effect good communication with land-based receivers.

Turning now to the antenna array 12, its first and second parts are powered by the device (RF generator) 20 such that the first part thereof (radiators 16*a*) is driven substantially in phase quadrature with the second part (radiators 16*b*) and such that both parts are driven at substantially equal power levels. This is achieved in a manner similar to that used for the array 10. That is, an RF transmission line 30 couples the generator 20 to a midpoint 32 of this array's first part (equal number of radiators 16*a* are above and below the point 32), and an RF transmission line 34 couples the device 20 to a midpoint 36 of the array's second part. Further, the lengths of the lines 30 and 34 are selected such that their respective lengths cause a relative 90 degree phase difference to occur between the signals at points 32 and 36. This phase difference is selected so that radiation from the radiators 14*a* which is received by radiators 16*a* cancels the radiation emitted by the radiators 14*b* and received by the radiators 16*b*. Ordinarily, this is achieved by selecting the lines 22 and 30 to be of substantially equal length and the feed lines 26 and 34 to also be of substantially the same length. In any case, the relative phase difference between the signals at points 32 and 36 should be substantially the same as the relative phase difference between the signals at points 24 and 28 (both leading or lagging by substantially equal quadrature phases).

To implement the present method most advantageously, the antenna arrays 10 and 12 should be closely spaced so that radiation from the first part of the array 10 (radiators 14*a*) which is directed toward the array 12 is received only by the first part of the array 12 (radiators 16*a*), and radiation from the second part of the array 10 (radiators 14*b*) is received only by the second part of the array 12 (radiators 16*b*). Stated another way, substantially no radiation from radiators 14*b* should be received by radiators 16*a*, and substantially no radiation from radiators 14*a* should be received by radiators 16*b*. This is preferably achieved by selecting the maximum spacing between the arrays to be substantially equal to or less than the height of the arrays.

The effect which the foregoing criteria have on isolation will now be described in terms of the way radiation from the array 10 is cancelled before reaching the device 20. Radiation from the radiators 14*a* is received by the radiators 16*a* and is coupled to the junction of feed lines 30 and 34 (node 38). Radiation from the radiators 14*b* is received by the radiators 16*b* and is also coupled to the node 38. However, the latter signal is phase shifted by an additional 90 degrees due to the length of the feed line 34. Consequently, a 180 degree phase difference exists between the signals coupled to the node 38 by the feed lines 30 and 34. Thus, the radiation received by the array 12 cancels at the node 38 before reaching the RF generator 20. The same cancelling effect occurs with respect to radiation from the array 12 which is coupled via radiators 14*a* and 14*b* to node 40.

As stated above, adjacent antenna arrays will ordinarily not be separated by more than the height of the arrays. In a typical land mobile antenna installation, the height of the antenna arrays is about ten feet. Accordingly, such antenna arrays constructed in accordance with the invention will be spaced apart no more than about ten feet. The primary limitation on how closely spaced adjacent arrays may be is capacitive coupling between the arrays. Hence, adjacent arrays should be separated from each other sufficiently to prevent one array from capacitively shorting an adjacent array.

In the example shown in FIG. 1, each part of each array includes an equal number of radiators. While this condition is preferred because of the improved bandwidth obtained, it is not critical. The number of radiators in one part of an array need not be equal to the number of radiators in the other part, but both parts of the array should be driven at equal power levels.

The phase delays associated with the arrays of FIG. 1 are preferably provided by employing feed lines of different lengths. However, similar phase delays may be effected by employing conventional phase shift networks, delay networks and the like. It should also be understood that an antenna installation constructed according to the invention may include more than two antenna arrays, each of which will achieve a high degree of isolation when the installation is constructed in accordance with the foregoing. In addition, the invention may be employed with antenna arrays which do not operate at or near the same frequency. When operating at substantially different frequencies, quadrature phasing may be obtained by employing a conventional wideband quadrature hybrid network between an RF generator (or receiver) and the feed lines to the radiators.

In the situation where two or more antennas are transmitting at different frequencies, the phase delays are preferably selected by computations based on an intermediate frequency. For example, when the arrays 10 and 12 are transmitting at frequencies of 450 megahertz and 470 megahertz, respectively, the lengths of the feed lines may be selected to provide the required quadrature phasing at a frequency of 460 megahertz.

In the case where the device 20 is a receiver rather than an RF generator, the construction of the array 12 may be identical to that shown in FIG. 1. In either case the first and second parts of the array 12 will be coupled to the device 20 via a signal path (feed lines 30 and 34) such that substantially quadrature phasing is established between the first and second parts of the array 12 so that received radiation emitted by the first part of the array 10 cancels received radiation from the second part of the array 10 in the signal path before reaching the device 20.

Figure 2:
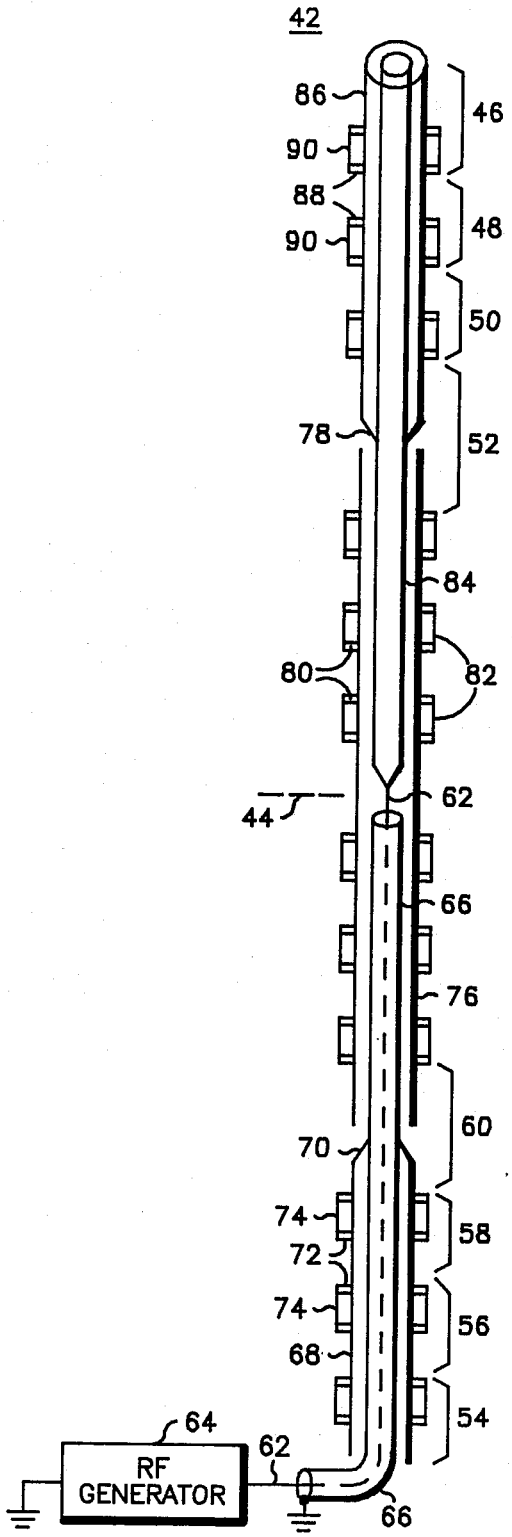
FIG. 2 is a partly sectional view of a single series/parallel antenna array powered by an RF generator according to the invention.

Turning now to FIG. 2, a single series/parallel antenna array 42 is shown to illustrate how this type of array may be driven according to the invention. Of course, one or more similar arrays will be included in an actual installation. The illustrated array includes a first part which extends above a line 44 and a second part which extends below the line 44. Each such part is shown as including seven radiators. In the top part of the array, three identical radiators 46, 48 and 50 are situated above a dipole radiator 52. Between the dipole 52 and the line 44, three more radiators are shown which may be identical to the radiators 46, 48 and 50.

In the lower part of the array, three radiators 54, 56 and 58 are situated immediately beneath a dipole radiator 60. Between the dipole 60 and the line 44, three more radiators are shown which may be identical to the radiators 54, 56 and 58.

In construction, the antenna array 42 includes an input coaxial cable comprising an inner conductor 62 and an outer conductor 66 which is coupled to an RF generator 64. The outer conductor 66 may be in the form of a tube and extends upwardly, as shown, nearly to the line 44.

Surrounding the conductor 66 is another tubular conductor 68 which extends from the bottom radiator 54 to a point 70 at which the conductor 68 connects to the conductor 66. The point 70 corresponds to the feed point of the lower part of the antenna array.

Mounted on the conductor 68 are annular insulators 72 which support annular conductive sleeves 74 to form part of the radiators 54, 56 and 58.

Above the point 70, another tubular conductor 76 surrounds the conductor 66 and extends to another point 78. This point 78 corresponds to the feed point of the upper part of the array 42.

In the upper part of the array, annular insulators 80 (similar to insulators 72) are mounted on the conductor 76 for supporting annular conductive sleeves 82 (similar to sleeves 74) to form part of the radiators which lie between the point 78 and the line 44.

Referring again to the conductor 62, the diameter of this conductor increases as shown at the location of the line 44. Above the line 44, this larger diameter conductor carries the reference numeral 84 and extends to the upper end of the array 42. Another tubular conductor 86 surrounds the conductor 84 from the upper end of the array to the point 78, at which point the conductor 86 joins to the conductor 84. Mounted on the conductor 86 are annular insulators 88 which support conductive sleeves 90 (similar to sleeves 82 and 74) to form part of the radiators 46, 48 and 50.

The antenna construction as described above provides 7 radiators in the upper part of the array and 7 radiators in the lower part of the array. The radiators of the type such as 46 each have a length corresponding to one wavelength. The length of the two dipoles 52 and 60 is adjusted to obtain a desired input impedance at the points 70 and 78. In addition, the RF signals applied to the upper and lower parts of the array are in phase quadrature.

Figure 3:
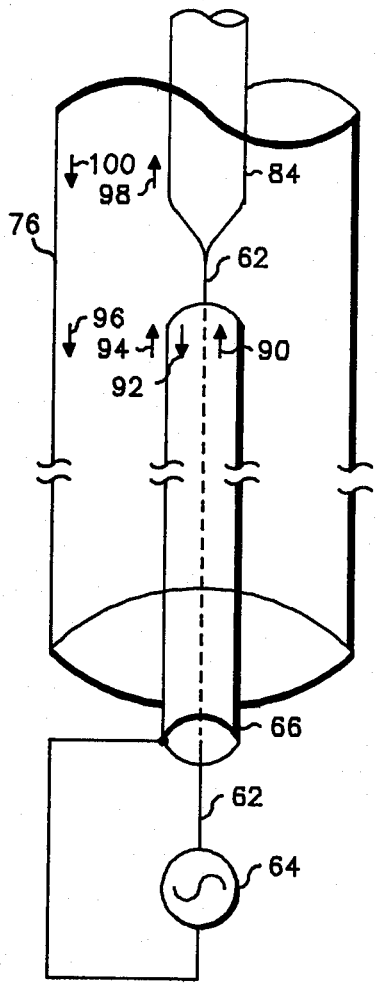
FIG. 3 is a highly schematic representation of an antenna array of the type shown in FIG. 2 for use in explaining how the FIG. 2 array is driven.

Referring to FIG. 3, a simplified representation is shown of the input portion of the array 42 of FIG. 2 and the portion where the diameter of the inner conductor 62 increases. This simplified drawing illustrates more clearly how the antenna array is fed. As shown, the conductors 62 and 66 comprise an input transmission line to the array. A current 90 flows in the conductor 62, and a current 92 flows on the inner surface of the conductor 66.

The outer surface of the conductor 66 and the inner surface of the conductor 76 support currents 94 and 96 to form, for the lower part of the array, another transmission line which is fed by the input transmission line. The conductor 84 and the inner surface of the conductor 76 support currents 98 and 100 to form a transmission line feeding the upper part of the array.

Thus, in FIG. 2, at the point where the diameter of the conductor 62 increases, the outer surface of the conductor 66 and the inner surface of the conductor 76 comprise a transmission line for feeding the lower part of the antenna array. The conductor 84 and the inner surface of the conductor 76 comprise another transmission line feeding the upper part of the array. To adjust the array to obtain quadrature phasing, the point where the diameter of the conductor 62 increases may be adjusted upwardly or downwardly, as required. Also, the conductor 66 should be physically shifted up or down by the same amount to maintain a constant gap between the upper end of the conductor 66 and the point where the diameter of conductor 62 increases. Thus, radiation from the upper part of the array will be in phase quadrature with radiation emitted by the lower part of the array. When two or more such arrays are included in an antenna installation, their respective RF generators are isolated because of the cancelling effect described above in connection with FIG. 1. It has been determined that, in such an installation, approximately 40 db of isolation is maintained between the generators of adjacent arrays having a separation of about one wavelength from each other. This compares very favorably with conventional installations which were thought to provide about 17 db of isolation.

Figure 5:
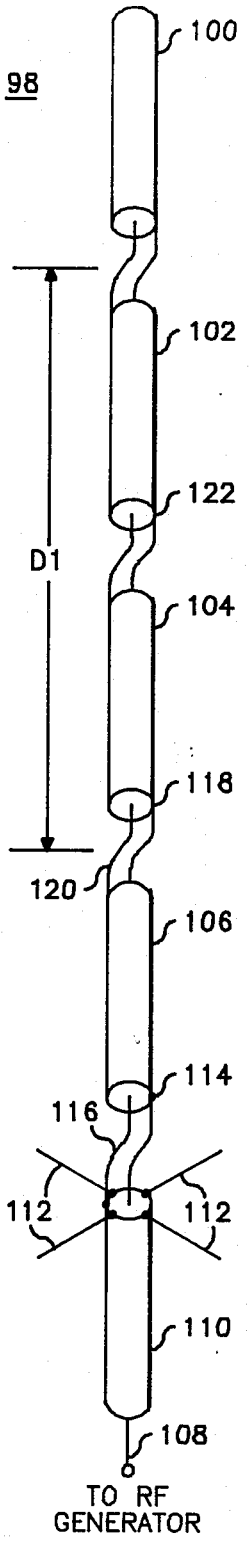
FIG. 5 is a more detailed view of the type of antenna array shown in FIG. 4.
Figure 4:
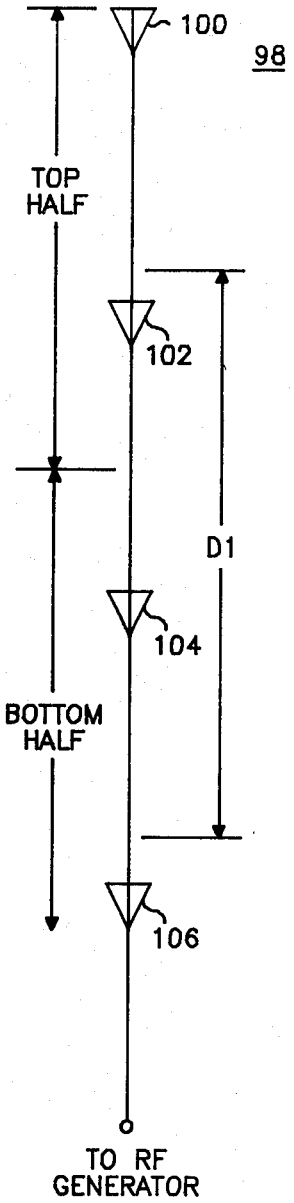
FIG. 4 is a schematic representation of a series fed array which is powered in accordance with the invention.

Referring now to FIGS. 4 and 5, a series-fed antenna array 98 is shown schematically in FIG. 4 and in more detail in FIG. 5. In these figures, like reference numerals identify like elements.

Turning first to FIG. 4, the array 98 comprises a top half and a bottom half. Two radiators 100 and 102 are included in the top half of the array, and two more radiators 104 and 106 are included in the bottom half of the array. Even though this array is illustrated as including but two radiators in each half for simplicity, a practical array may include 3, 4 or more radiators in each of its halves or parts.

To cause the upper and lower parts of the antenna array to be driven in phase quadrature, the distance shown as D1 in FIGS. 4 and 5 is selected to correspond to N (L/4) where N is an odd integer and L is the wavelength associated with the frequency of operation. D1 is measured from the center of radiation of the top half of the array to the center of radiation of the bottom half of the array. Thus, if N equals 7 and there are four radiators included within the distance D1, each radiator would have an electrical length of 7L/16. Since each radiator is electrically shorter than one-half wavelength, downward beam tilt will result in addition to driving the different halves of the array in phase quadrature.

Turning now to FIG. 5, the antenna array 98 may be driven from an RF generator (not shown) which couples to a coaxial feed line comprising an inner conductor 108 and an outer shield 110. The upper end of this feed line may support a number of decoupling radials 112 to prevent RF currents on the outside of the shield 110 from radiating in unpredictable ways.

Above the radials 112, the inner conductor 108 connects, at point 114, to a tubular conductor which forms part of the radiator 106. Another conductor 116 is coupled to the sleeve 110, and runs through the conductor 106 to a point 118 where it connects to another tubular conductor 104.

Yet another conductor 120 is coupled to the upper end of the conductor 106, passes through the tubular conductor 104, and connects to tubular conductor 102 at a point 122. The remainder of the connections between tubular conductors 100, 102 and 104 need not be described since they are clearly shown and are similar to those thus far described.

Suffice it to say that this arrangement, when constructed according to the criteria described in connection with FIG. 4, provides an array of two parts which is driven in phase quadrature. When two or more such arrays are employed in an antenna installation, the RF cancellation described previously occurs to provide improved isolation among RF generators.

As will be appreciated from the foregoing, the present invention provides the advantages of reduced space for an antenna installation with very good isolation between the RF generators associated with closely-spaced antenna arrays. Moreover, these results are obtained without the use of hybrid networks.

Although the invention has been described in terms of its application to specific structures, it will be obvious to those skilled in the art that various alterations and modifications may be made to suit a specific application. Accordingly, it is intended that all such modifications and alterations be considered as within the spirit and scope of the invention as defined in the appended claims.

What is claimed is:

1. In an antenna installation having at least first co-linear antenna array powered by an RF generator and a second co-linear antenna array which includes a plurality of radiators coupled to an RF communication device, a method for reducing the physical spacing between arrays while maintaining isolation between the RF generator and the RF communication device, comprising:

identifying, for the first array, first and second parts thereof for application of RF power thereto and, for the second array, first and second parts thereof for coupling to the RF communication device;

powering the first and second parts of the first antenna array with an RF generator such that said first and second parts thereof are driven substantially in phase quadrature with each other and at substantially equal power levels;

coupling the first and second parts of the second array to the RF communication device via a signal path such that substantially quadrature phasing is established between the first and second parts of the second array so that received radiation emitted by the first part of the first array cancels received radiation from the second part of the first array in the signal path before reaching the RF communication device; and adjusting the physical spacing between said first and second arrays such that the maximum spacing therebetween substantially precludes radiation emitted by the first part of the first array from being received by the second part of the second array, and substantially precludes radiation emitted by the second part of the first array from being received by the first part of the second array.

2. A method as set forth in claim 1 wherein said RF communication device includes a radio receiver.

3. A method as set forth in claim 1 wherein said RF communication device includes an RF generator, and wherein the first and second parts of the second array are driven at substantially equal power levels.

4. A method as set forth in claim 1 wherein each antenna array includes a plurality of radiators, and wherein the number of radiators in the first part of an array is selected to be equal to the number of radiators in the second part of the same array.

5. A method as set forth in claim 4 wherein each part of the first array includes a midpoint above and below which equal number of radiators are situated, and wherein each part of the first array is powered by coupling an RF feed line between each midpoint and the RF generator.

6. A method as set forth in claim 5 wherein the feed lines to the first and second parts of the first array are selected to provide a relative phase shift of substantially ninety degrees for driving said first and second parts in phase quadrature with each other.

7. In an antenna installation having at least two closely-spaced antenna arrays, each having a plurality of radiators powered by RF generators operating at relatively closely-spaced frequencies, a method for reducing the physical spacing between arrays while main taining a high level of isolation between the RF generators, comprising:

identifying, for each antenna array, first and second parts thereof such that the first and second parts of each array include an equal number of radiators;

powering the first and second parts of the first antenna array with an RF generator such that the first and second parts thereof are driven substantially in phase quadrature with each other and at substantially equal power levels;

powering the first and second parts of the second antenna array with a second RF generator such that the first and second parts thereof are driven substantially in phase quadrature with each other, at substantially equal power levels, and such that radiation from the first array received by the first part of the second array cancels radiation emitted by the first array received by the second part of the second array; and limiting the physical spacing between the first and second arrays to a distance corresponding to no more than about the heights of the arrays.

* * * * *